US009032572B1

(12) United States Patent
Leach

(10) Patent No.: US 9,032,572 B1
(45) Date of Patent: May 19, 2015

(54) INFANT CARE ACCESSORY COMPRISING COMBINATION DIAPER BAG AND CHANGING MAT WITH FLUID BARRIER

(76) Inventor: Jamie S. Leach, Ada, OK (US)

( * ) Notice: Subject to any disclaimer, the term of this patent is extended or adjusted under 35 U.S.C. 154(b) by 877 days.

(21) Appl. No.: 12/852,158

(22) Filed: Aug. 6, 2010

Related U.S. Application Data

(60) Provisional application No. 61/241,167, filed on Sep. 10, 2009.

(51) Int. Cl.
*A47D 5/00* (2006.01)
*A47G 9/10* (2006.01)
*A47D 15/00* (2006.01)

(52) U.S. Cl.
CPC ..... *A47D 5/00* (2013.01); *A47G 9/1045* (2013.01); *A47D 15/003* (2013.01); *A47D 5/006* (2013.01)

(58) Field of Classification Search
CPC .... A47D 5/006; A47D 15/003; A47G 9/1045
USPC ..... 5/417, 652, 655, 482; 224/610; 190/102
See application file for complete search history.

(56) References Cited

U.S. PATENT DOCUMENTS

| | | | | |
|---|---|---|---|---|
| 2,429,350 | A | | 10/1947 | Farrand |
| 2,502,486 | A | | 4/1950 | Savrin |
| 2,626,407 | A | | 1/1953 | Kurry |
| 2,652,183 | A | | 9/1953 | Hlivka |
| 3,778,570 | A | | 12/1973 | Shuman |
| 4,154,323 | A | | 5/1979 | Sneider |
| 4,227,270 | A | | 10/1980 | Rivera |
| 4,489,815 | A | | 12/1984 | Martinez et al. |
| 4,566,130 | A | * | 1/1986 | Coates ..... 383/15 |
| 4,606,087 | A | | 8/1986 | Alivizatos |
| 4,698,862 | A | | 10/1987 | Mairs |
| 4,712,258 | A | | 12/1987 | Eves |
| 4,723,300 | A | * | 2/1988 | Aranow ..... 383/4 |
| D299,988 | S | | 2/1989 | Parabita |
| 4,834,459 | A | | 5/1989 | Leach |
| 4,853,994 | A | * | 8/1989 | Ekstein ..... 5/639 |
| 4,861,109 | A | | 8/1989 | Leach |
| 4,863,003 | A | * | 9/1989 | Carter ..... 190/8 |
| 4,886,150 | A | * | 12/1989 | Fitzsimmons ..... 190/1 |
| D309,018 | S | | 7/1990 | Leach |
| 4,999,863 | A | | 3/1991 | Kane |
| 5,035,013 | A | | 7/1991 | Bloom |
| 5,103,514 | A | | 4/1992 | Leach |
| 5,115,524 | A | | 5/1992 | Antosko |
| 5,179,741 | A | | 1/1993 | Book |
| 5,210,891 | A | | 5/1993 | Avital et al. |
| 5,325,818 | A | | 7/1994 | Leach |

(Continued)

*Primary Examiner* — Peter M Cuomo
*Assistant Examiner* — Brittany Wilson
(74) *Attorney, Agent, or Firm* — Mary M. Lee

(57) ABSTRACT

An infant care accessory comprising a combination diaper bag and changing mat. The accessory comprises a body having a two side panels and a center panel. When the side panels are upright, the body forms a diaper bag. When the side panels are opened flat with the center panel, the body forms a diaper changing mat. The inside surface of the body is made of fluid impermeable material, and a fluid barrier is positioned along the center panel. The fluid barrier may be a strip of absorbent material. When a baby is placed lengthwise on the opened out body with the center panel positioned at about the baby's waist, urine and other body fluids will be blocked or absorbed by the fluid barrier and will not travel up under the baby's back and head. A removable accessory pouch may be included for carrying diapers, lotion, powder, and other changing essentials.

16 Claims, 5 Drawing Sheets

(56) References Cited

U.S. PATENT DOCUMENTS

| | | | | |
|---|---|---|---|---|
| 5,402,869 | A | 4/1995 | Saltzman et al. | |
| 5,404,600 | A | 4/1995 | DeMars | |
| D366,368 | S | 1/1996 | McCarthy | |
| 5,615,433 | A | 4/1997 | Martin | |
| D382,642 | S | 8/1997 | Van Gisbergen Rutherford | |
| 5,692,257 | A | 12/1997 | Albertieri | |
| 5,743,649 | A * | 4/1998 | Gonzalez | 383/6 |
| 5,785,219 | A | 7/1998 | Kraft | |
| 5,916,089 | A | 6/1999 | Ive | |
| 6,009,576 | A | 1/2000 | Gramme et al. | |
| 6,154,904 | A | 12/2000 | Ehredt | |
| 6,343,727 | B1 | 2/2002 | Leach | |
| 6,370,715 | B1 | 4/2002 | Morton | |
| 6,375,643 | B1 | 4/2002 | Moorhead et al. | |
| 6,427,251 | B1 | 8/2002 | Leach | |
| D467,117 | S | 12/2002 | Guy | |
| 6,499,164 | B1 | 12/2002 | Leach | |
| 6,553,590 | B1 | 4/2003 | Leach | |
| 6,601,252 | B1 | 8/2003 | Leach | |
| 6,694,552 | B1 | 2/2004 | Vickers | |
| 6,704,953 | B2 | 3/2004 | Fishman | |
| 6,715,594 | B2 * | 4/2004 | Milionta et al. | 190/110 |
| 6,751,817 | B1 | 6/2004 | Leach | |
| 6,760,934 | B1 | 7/2004 | Leach | |
| 6,920,655 | B2 | 7/2005 | Mitchell | |
| 7,000,766 | B2 | 2/2006 | Matthews Brown et al. | |
| 7,010,821 | B1 | 3/2006 | Leach | |
| 7,114,206 | B2 | 10/2006 | Leach | |
| 7,152,772 | B2 | 12/2006 | Ukitsu et al. | |
| 7,322,057 | B2 | 1/2008 | Merlini | |
| 7,353,552 | B2 | 4/2008 | Leach | |
| 7,500,278 | B2 | 3/2009 | Leach | |
| 7,513,001 | B1 | 4/2009 | Leach | |
| 7,562,406 | B1 | 7/2009 | Leach | |
| 7,676,871 | B1 | 3/2010 | Leach | |
| 7,708,342 | B2 | 5/2010 | Leach | |
| 7,761,944 | B2 * | 7/2010 | Skophammer | 5/655 |
| 7,793,371 | B1 | 9/2010 | Leach | |
| 7,878,587 | B1 | 2/2011 | Leach | |
| 7,926,135 | B1 | 4/2011 | Leach | |
| 8,037,561 | B2 * | 10/2011 | Austwick et al. | 5/655 |
| 8,051,510 | B2 * | 11/2011 | Soloway | 5/417 |
| 2004/0078020 | A1 | 4/2004 | Kawata et al. | |
| 2005/0263556 | A1 * | 12/2005 | Labit et al. | 224/610 |
| 2005/0278864 | A1 | 12/2005 | Leach | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0102078 | A1 * | 5/2007 | Shimp | 150/113 |
| 2007/0151031 | A1 | 7/2007 | Leach | |
| 2007/0277321 | A1 | 12/2007 | Leach | |
| 2008/0028529 | A1 | 2/2008 | Abell | |

* cited by examiner

INFANT CARE ACCESSORY COMPRISING COMBINATION DIAPER BAG AND CHANGING MAT WITH FLUID BARRIER

CROSS-REFERENCE TO RELATED APPLICATIONS

This application claims the benefit of provisional application Ser. No. 61/241,167, filed Sep. 9, 2009, entitled "Infant Care Accessory Comprising Combination Diaper Bag and Changing Mat with Urine Catcher," the contents of which are incorporated herein by reference.

FIELD OF THE INVENTION

The present invention relates generally to infant care products and, more particularly, to diaper bags and changing mats.

DETAILED DESCRIPTION OF THE PREFERRED EMBODIMENT(S)

When an infant is having a diaper changed and urinates before a new diaper can be placed under his or her bottom, urine and other body fluids can run backwards towards the head. In addition to urine that may be expelled before a new diaper is in place to absorb it, infants may have loose or watery stools. Still further, some infants have anatomical malformations, such as spina bifida and congenital anal fistulas, which can cause simultaneous excretion of both urine and stool. The spread of these body fluids underneath the baby can irritate the baby's skin and make more work for the caregiver. The infant care accessory of the present invention provides a convenient solution to these problems.

The infant care accessory of the present invention is a combination diaper bag and changing mat, preferably also including a detachable accessory pouch. The accessory comprises a body that opens out flat for use as a changing mat and then folds up into a diaper bag for travel. The inside surface of the body is made of a fluid impermeable material. As used herein, "fluid" refers body fluids, including urine and stool.

A fluid barrier extends across the body on the center panel. In this way, if body fluids contact the changing mat before the clean diaper is positioned under the baby, the fluids will be prevented from traveling upwards toward the baby's head and upper back. These and other advantages and features of the present invention will be apparent from the following description of a preferred embodiment.

Figure 1:
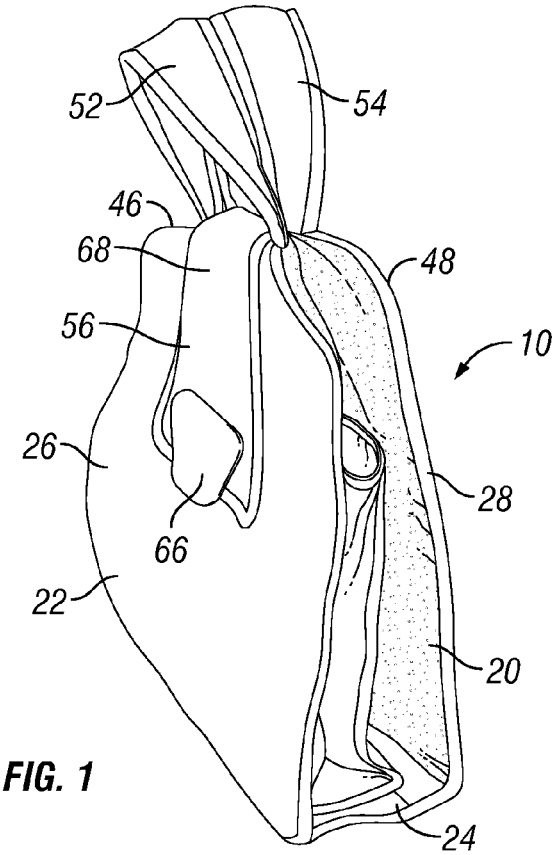
FIG. 1 is a side perspective view of an infant care accessory comprising a combination diaper bag and changing mat made in accordance with the present invention. The accessory is shown in the diaper bag configuration.

Turning now to the drawings in general and to FIG. 1 in particular there is shown therein an infant care accessory in accordance with a preferred embodiment of the present invention and designated generally by the reference number 10. The accessory 10 preferably comprises a combination diaper bag and changing mat. To that end, the accessory 10 preferably includes a body 12 and a removable accessory pouch 14.

The body 12 will be explained in more detail with reference to FIGS. 2-5. The body 12 preferably comprises an inner surface 20 and an outer surface 22. The outer surface preferably is made of some durable, washable fabric, as it will be the surface that is laid across the underlying support. Of course, it is ideal if the fabric is ornamental, but this is not essential.

As the inner surface 20 is the surface on which the infant is placed for a diaper change, the inner surface preferably is made of a fluid-impermeable material. Suitable materials include vinyls, plastics, poly-laminated fabrics, waterproof and breathable laminate fleece, urethane-coated and water repellent/resistant fabrics, and any type of fabric with a coating either on the exposed side or underside that does not allow fluids to penetrate. The fabric of the inner surface may be the same print as that of the outer surface 22, or it may be contrasting or coordinating.

Figure 5:
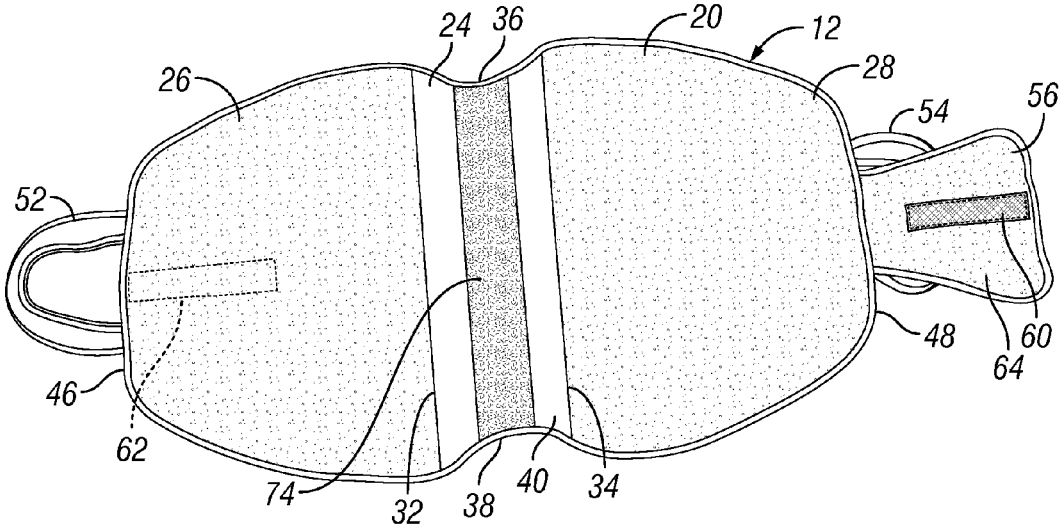
FIG. 5 is a plan view of the accessory in the diaper changing mode, that is, fully opened with the interior side facing upward and the pouch removed.

The body 12 preferably comprises a center panel 24 flanked by first and second side panels 26 and 28. The term "panel" denotes merely a generally area on the body; the term does not require that the area be physically or structurally distinct. With reference now to FIG. 5 and no also to FIG. 7, the center panel 24 may be generally rectangular in shape as this promotes stability in the closed position described hereafter. Regardless of shape, in most instances the center panel 24 will have spaced apart first and second borders or sides 32 and 34 and first and second ends 36 and 38. Thus, regardless of shape, the length of the center panel 24 will be the dimension between the first and second ends 36 and 38, and the width will be the dimension between the first and second sides 32 and 34. The width of the center panel may vary; an ideal width is from about 1 to about 6 inches and more preferably about 4 inches.

A fluid barrier is fixed lengthwise on the center panel 24. The fluid barrier is adapted to prevent body fluids on one side of the center panel 24 from flowing onto the other side of the panel. To that end, the fluid barrier may be absorbent fabric so that the fluid is at least partially captured in the fabric. Alternately, the fluid barrier may be a structural element that blocks or diverts the flow of fluids. For example, the fluid barrier may comprise a raised element, such as a rib, ridge, pleat, or flange, or a recessed structure such as a groove, channel, or indentation.

Most preferably, this fluid barrier is a strip 40 of absorbent material that is co-extensive with the center panel 24. This strip 40*t* may be wider or narrower, and it may be longer or shorter than the length of the center panel 24. The absorbent material may be the same material as that used for the outer surface 22, as most fabrics that are not water repellant are relatively absorbent. Alternately, a material such as terry cloth may be employed.

With continuing references to FIGS. 1-5, the first side panel 26 extends from the first side 32 of the center panel 24 and has a free edge 46 opposite the first side of the center panel. Likewise, the second side panel 28 extends from the second side 34 of the center panel 24 and has a free edge 48 opposite the first side of the center panel.

Preferably, the body 12 includes a handle. While the handle may take several forms, in the preferred embodiment the handle comprises at least a first looped strap on the free end of the one of the first and second side panels. More preferably, the handle comprises a first looped strap 52 on the free edge 46 of the first side panel 26 and a second looped strap 54 on the free edge 48 of the second side panel 28. This provides good balance and stability when carrying the accessory 10 in the closed or diaper bag configuration.

Figure 2:
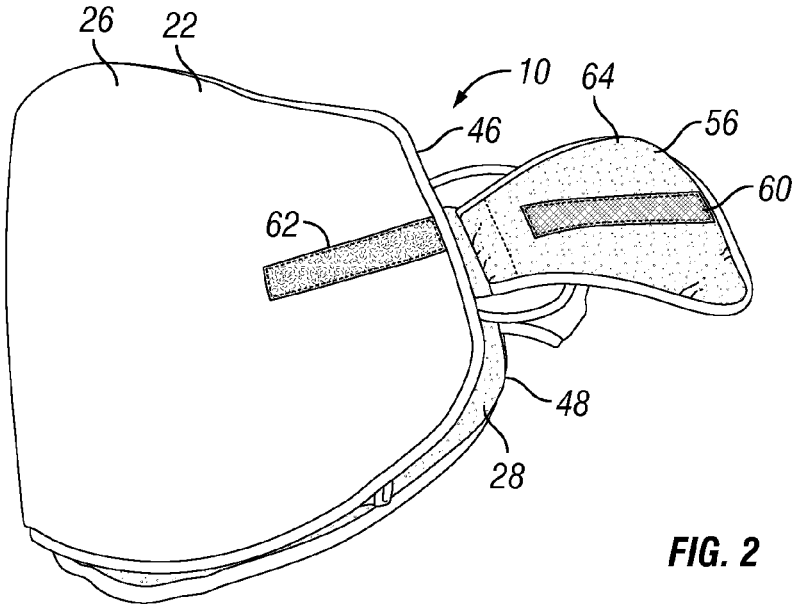
FIG. 2 is side perspective view of the accessory of FIG. 1 placed on its side with closure flap folded back.
Figure 3:
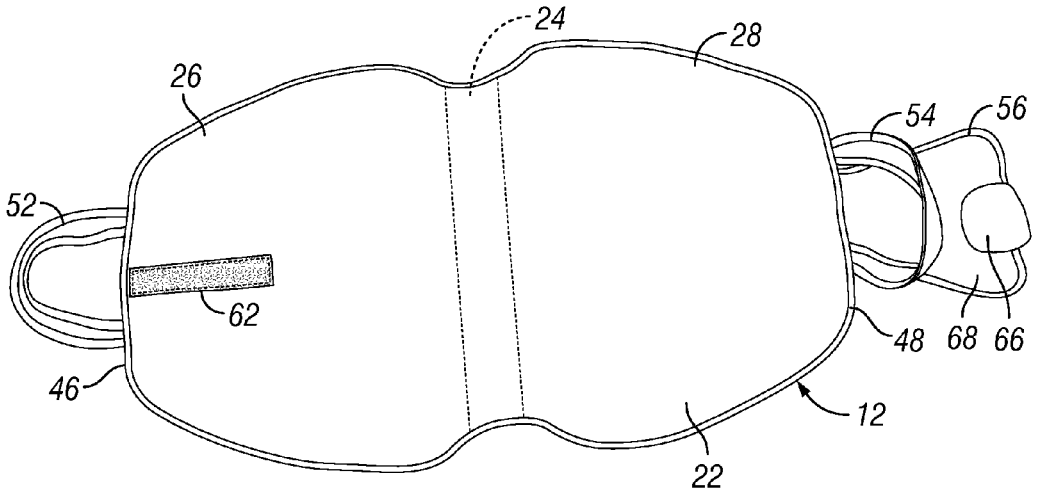
FIG. 3 is a plan view of the accessory fully opened and with the interior side facing downward.

The body 12 may also include a connector to secure the body in the closed position, as best seen in FIGS. 1 and 2. Preferably, the connector takes the form of a closure flap 56. The flap 56 may be attached to the free edge of one of the side panels 26 and 28, such as the free edge 48 of the second side panel 28, and most preferably is positioned so that it extends from inside the looped handle 54. In this way, the flap 56 can be inserted through the other looped handle 52 and connected to the outer surface of the body 12 on the first side panel 26.

This connection may take any suitable form, such as straps, buttons, buckles, ties, snaps, hooks, and the like. It is most desirable if the connection is adjustable. Accordingly, in the preferred embodiment, the connector comprises mating strips 60 and 62 of hook and loop fastener arranged vertically, when viewed in the closed or diaper bag mode as seen in FIG. 1. The "soft" strip 60 should be on the inner surface 64 of the flap 56. Alternately, the strips 60 and 62 could be arranged horizontally, one can be horizontal and the other vertical. Regardless of size, shape, and arrangement, it is most preferably that the connector be adjustable.

The flap 56 is advantageously formed of the same two cover fabrics as the rest of the body 12 for reasons that will become apparent. A decorative element 66 may be included on the outer side 68 of the flap 56. While the number and nature of decorative elements is unlimited, examples include bows, flowers, appliqués, buttons, and the like.

Figure 4:
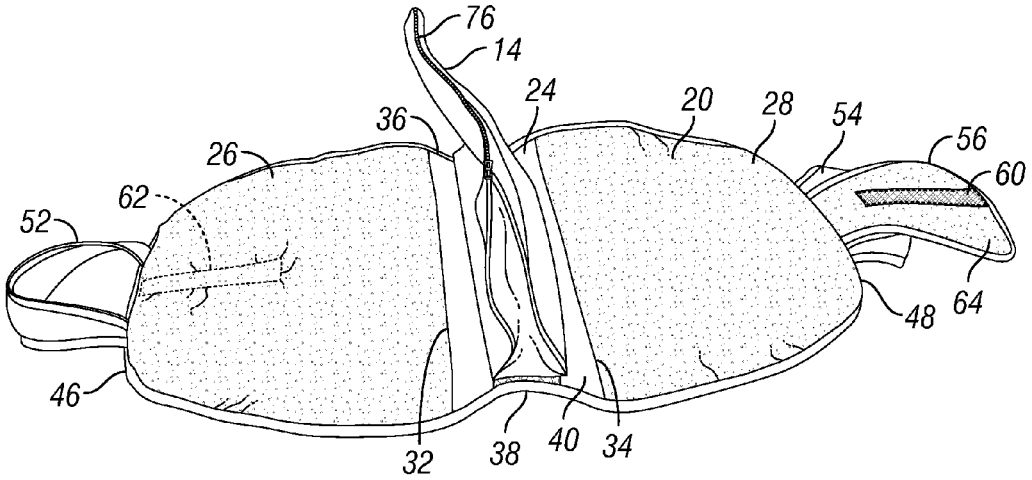
FIG. 4 is a side perspective view of the accessory fully opened with the interior side facing upward and showing the removable pouch secured to the accessory.
Figure 6:
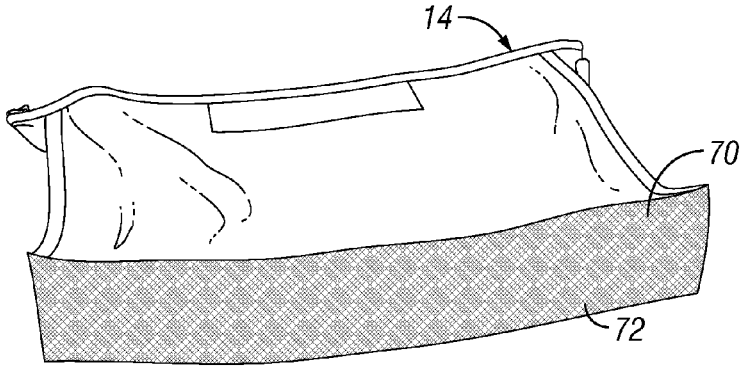
FIG. 6 is a bottom perspective view of the removable pouch preferably included in the accessory and showing the fastener fabric strip across its bottom.

Referring now to FIGS. 1, 4 and 6, the accessory pouch 14 will be described in more detail. The pouch 14 may have virtually any shape and size that fits easily inside the body 12 and is suitable for containing diapers, wipes, and other changing essentials. A rectangular bottom panel 70 is preferred as it is more stable when the pouch alone or inside the accessory 10 (FIG. 1) is free standing.

A flat rectangular bottom 70 also provides a convenient location for a strip 72 of hook and loop fastener, which is attachable to a mating strip 74 of hook and loop fastener positioned lengthwise on the center panel 24 of the body 12. Most preferably, the strip 74 is the "soft" strip, as it will be under the infant during changing. The pouch 14 may be made of virtually any fabric, however, an open weave, mesh, or netting type fabric is ideal as it reduces the likelihood of mildew resulting from wet diapers in the pouch. The opening of the pouch 14 includes some closure device, such as a zipper 76, but other devices such as hook and loop fastener strips, buttons, snaps, ties, or the like may used instead.

Various techniques for making the accessory 10 will be apparent. In one preferred method, the inner surface 20 and the outer surface 22 each are formed of a single, unitary sheet of material cut into the same shape. Usually, a third sheet of batting or other padded material (not shown) is included between the inner and outer surfaces 20 and 22. The closure flap 56 may be formed similarly.

Figure 7:
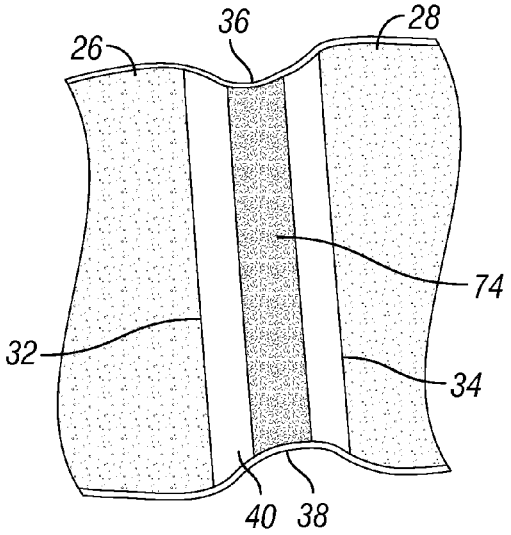
FIG. 7 is an enlarged view of the center panel comprising a fluid barrier in the form a strip of absorbent barrier and an overlying strip of hook and loop fastener.

The absorbent barrier 40 and the fastener strip 74 can be stitched or otherwise secured across the center of the inner surface 20 to form the center panel 24. In most instances, the fastener strip 74 will be the same length as the absorbent strip 40, that is, both strips 40 and 74 will extend from end 36 to end 38, as shown in FIG. 7. In some instances, the absorbent strip 40 and the fastener strip 74 will be the same strip of fabric. For example, if the strip 74 of fastener material is sufficient absorbent, it may serve as the absorbent strip 40 as well.

Once the strips 40 and 74 have been positioned over the inside surface, the three layers are stitched or otherwise attached around the periphery. The free edges of the handles 52 and 54 and the flap 56 can be stitched into the seam around the edge with decorative piping or other edge treatment.

Now it will be apparent that the body 12 of the accessory 10 is configured so that the side panels 26 and 28 are foldable relative to the center panel 24 so that the side panels are movable between an open position and a closed position. The folding may be encouraged by seam formed by attachment of one or both of the absorbent strip 40 and the fastener strip 74. However, no fold line need be specifically delineated.

In the closed position, shown in FIG. 1, the side panels 26 and 28 are generally upright and side by side forming an enclosure that may serve as a tote bag or diaper bag. Although not essential, the ends of the body 12 in the closed position will be open to allow air to circulate through the inside of the enclosure. This will discourage mildew.

In the open position shown in FIG. 5, the first and second side panels 26 and 28 generally co-planar with the center panel 24 forming a continuous diaper changing area. Now it will seen that the inner surface 64 of the closure flap 56 opens out to form an extension of the changing area.

Figure 8:
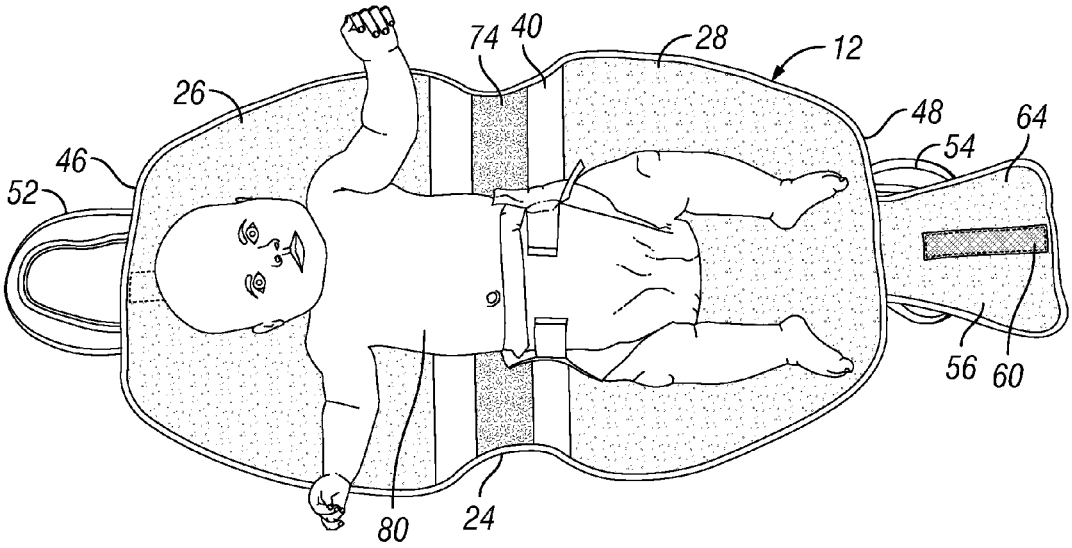
FIG. 8 is a plan view of the accessory in the diaper changing mode and illustrating a baby positioned over the center panel. The closure flap is folded out to provide additional work area.
Figure 9:
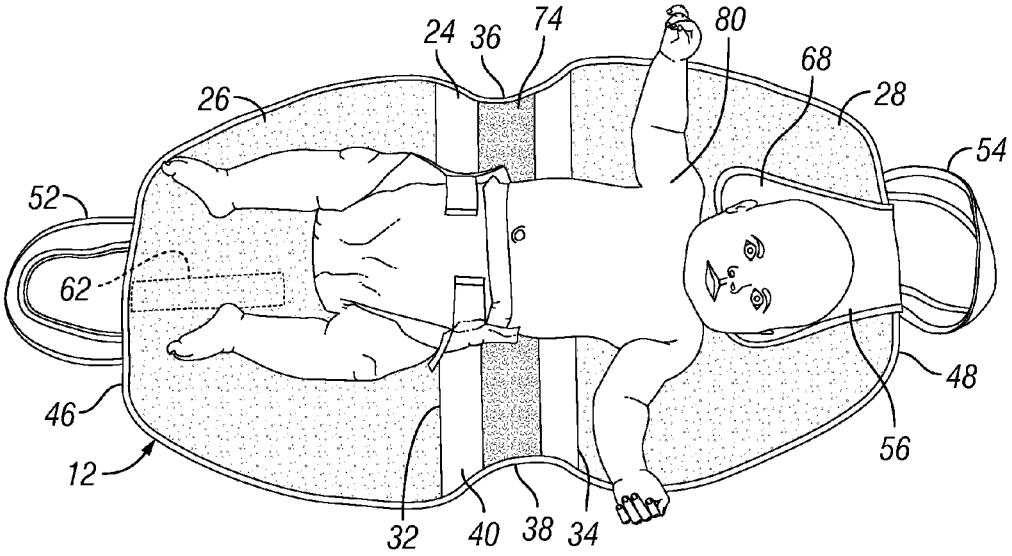
FIG. 9 is a plan view of the accessory in the changing pad mode and illustrating a baby positioned over the center panel. The closure flap is folded in over the side panel and the baby is positioned with his head resting on the closure flap, which provides extra cushioning.
Figure 10:
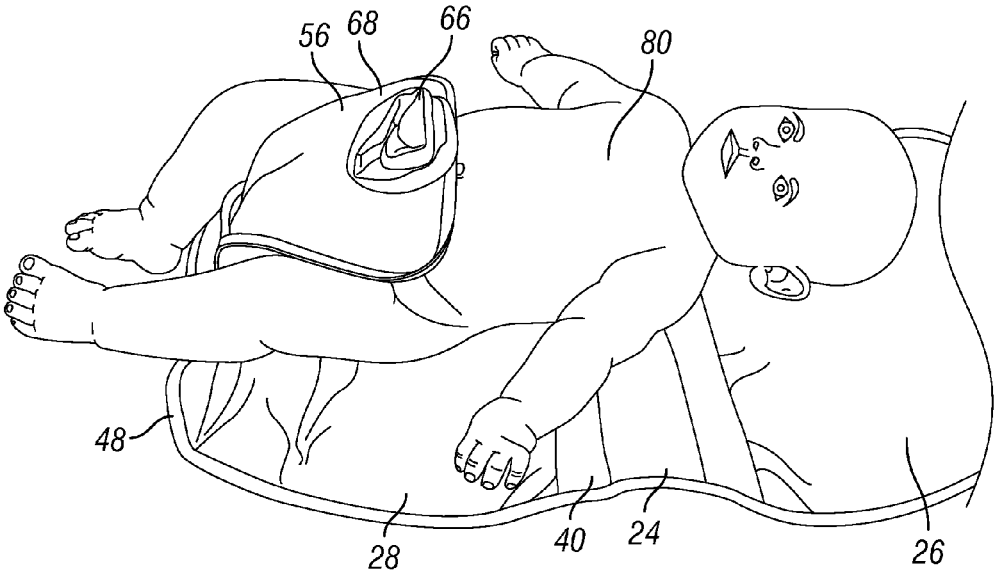
FIG. 10 is a plan view of the accessory in the changing pad mode and illustrating a baby positioned over the side panel with closure flap. The closure flap is folded in over the baby's groin.

The use of the accessory 10 is illustrated in FIGS. 8-10 to which attention now is directed. As shown in FIG. 8, the infant 80 may be placed with her upper body on the first side panel 26 and her legs over the second side panel 28 so that bottom is across the center panel 24. In this position, the flap 56 provides additional work surface for the caregiver during changing.

Alternately, as shown in FIG. 9, the infant 80 may be placed with her upper body on the second side panel 28 with flap 56 folded in under head and serving as a pillow. Now it will be understood why it is desirable to use the soft hook and loop strip for the strip 60 on the flap 56, and the infant's head may rest directly upon it. Although now illustrated in the drawings, the flap 56 may also be folded back under the side panel 28 and still provide additional cushioning for the infant's head.

Yet another position is shown in FIG. 10 and is useful especially for male infants. Here, the infant's bottom is placed closed to the free edge 48 of the second panel 28, and the closure flap 56 is folded in over the infant's lower body. This protects the caregiver from an upward stream of urine if the male infant urinates after the soiled diaper is removed and before the clean diaper is in place.

In all the positions illustrated, the fluid barrier 40 will prevent urine and other fluids on the inner surface 20 of the body 12 from flowing up under the infant's upper body (or at least the infant's head in FIG. 10). In the preferred embodiment, the fluids are absorbed at least partly by the absorbent material 40, and the accessory 10 can then be machine washed.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. An infant care accessory comprising:

a body having an inner surface and an outer surface, and wherein the body comprises:

a center panel having spaced apart first and second sides and first and second ends, the length of the center panel being the dimension between the first and second ends and the width being the dimension between the first and second sides, wherein the center panel has a fluid impermeable inner surface;

a first side panel extending from the first side of the center panel and having a free edge opposite the first side, wherein the first side panel has a fluid impermeable inner surface;

a second side panel extending from the second side of the center panel and having a free edge opposite the first side, wherein the second side panel has a fluid impermeable inner surface;

wherein the inner surfaces of the first and second side panels and inner surface of the center panel together form a continuous fluid impermeable diaper changing area;

a fluid barrier fixed lengthwise on the inner surface of the center panel, the barrier adapted to prevent body fluids from crossing from the diaper changing area on one side of the barrier to the diaper changing area on the other side of the barrier; and wherein the first and second side panels are foldable relative to the center panel so that the first and second side panels are movable between an open position and a closed position, wherein in the open position the first and second side panels are generally co-planar with the center panel, and wherein in the closed position the first and second side panels are generally upright and side by side forming at least a partial enclosure with the center panel forming a flat bottom.

2. The infant care accessory of claim 1 further comprising a handle on the body.

3. The infant care accessory of claim 2 wherein the handle comprises a first looped strap on the free end of one of the first or second side panels.

4. The infant care accessory of claim 3 wherein the handle comprises a second looped strap on the free end of the other of the first or second side panels.

5. The infant care accessory of claim 1 further comprising a connector on the body to secure body in the closed position.

6. The infant care accessory of claim 5 wherein the connector is a flap attached to the free edge of one of the first and second side panels.

7. The infant care accessory of claim 1 further comprising an accessory pouch removably attachable to the body.

8. The infant care accessory of claim 7 wherein the accessory pouch is attachable to the body along the center panel.

9. The infant care accessory of claim 8 further comprising a first strip of hook and loop fastener along the length of the center panel and a second, mating strip of hook and loop fastener on the accessory pouch.

10. The infant care accessory of claim 8 wherein the first strip of hook and loop fastener along the length of the center panel and the fluid barrier are separate pieces of fabric.

11. The infant care accessory of claim 9 wherein the accessory pouch has a rectangular bottom panel and wherein the second, mating strip of hook and loop fastener on the pouch is positioned lengthwise on the bottom of the bottom panel.

12. The infant care accessory of claim 1 wherein the fluid impermeable material comprises vinyl, plastic, poly-laminated fabric, waterproof and breathable laminate fleece, or urethane-coated fabric, or a combination thereof.

13. The infant care accessory of claim 12 wherein the outside surface is fabric.

14. The infant care accessory of claim 1 wherein the body is washable.

15. The infant care accessory of claim 1 wherein the fluid barrier is a strip of absorbent material having a width that is about the same as the width of the center panel.

16. The infant care accessory of claim 15 further comprising:

an accessory pouch removably attachable to the body along the center panel, wherein the accessory pouch has a rectangular bottom panel;

a first strip of hook and loop fastener along the length of the center panel; and a second, mating strip of hook and loop fastener positioned lengthwise on the bottom of the bottom panel.

* * * * *

UNITED STATES PATENT AND TRADEMARK OFFICE

CERTIFICATE OF CORRECTION

PATENT NO. : 9,032,572 B1
APPLICATION NO. : 12/852158
DATED : May 19, 2015
INVENTOR(S) : Jamie S. Leach It is certified that error appears in the above-identified patent and that said Letters Patent is hereby corrected as shown below:

On the Title Page, item (57):
Column 2, in the Abstract, line 3: replace “a two side” with --two side--.

In the Specification:
Column 1, line 25: replace “is side” with --is a side--.
Column 1, line 26: replace “with closure” with --with the closure--.
Column 1, line 39: replace “form a” with --form of a--.
Column 2, line 9: replace “refers body” with --refers to body--.
Column 2, line 19: replace “particular” with --particular,--.
Column 2, line 44: replace “generally” with --general--.
Column 2, line 46: replace “no” with --now--.
Column 2, line 49: replace “instances” with --instances,--.
Column 3, line 18: replace “the one” with --one--.
Column 4, line 2: replace “may used” with --may be used--.
Column 4, line 17: replace “sufficient” with --sufficiently--.
Column 4, line 28: replace “by seam” with --by a seam--.
Column 4, line 38: replace “28” with --28 are--.
Column 4, line 40: replace “will seen” with --will be seen--.
Column 4, line 45: replace “that” with --that her--.
Column 4, line 51: replace “under” with --under her--.
Column 4, line 59: replace “closed” with --close--.

In the Claims:
Column 6, line 13: replace “secure body” with --secure the body--.

Signed and Sealed this
Twenty-second Day of September, 2015

Michelle K. Lee

Michelle K. Lee
*Director of the United States Patent and Trademark Office*